US007140930B2

(12) United States Patent
Yamada et al.

(10) Patent No.: US 7,140,930 B2
(45) Date of Patent: Nov. 28, 2006

(54) THRUST CONTROL DEVICE FOR JET PROPULSION WATERCRAFT

(75) Inventors: Hiroshi Yamada, Irvine, CA (US); Toshio Araki, Kakogawa (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 189 days.

(21) Appl. No.: 11/011,981

(22) Filed: Dec. 13, 2004

(65) Prior Publication Data

US 2005/0130513 A1 Jun. 16, 2005

(30) Foreign Application Priority Data

Dec. 16, 2003 (JP) ..... 2003-417465

(51) Int. Cl.

| | |
|---|---|
| ***B63H 11/10*** | (2006.01) |
| ***B63H 11/107*** | (2006.01) |
| ***B63H 21/21*** | (2006.01) |
| ***F02D 29/00*** | (2006.01) |
| ***F02D 41/00*** | (2006.01) |

(52) U.S. Cl. ..... 440/1; 440/84; 440/87

(58) Field of Classification Search ..... 440/1, 440/2, 38, 40–43, 84, 87; 114/55.5, 55.52, 114/144 R See application file for complete search history.

(56) References Cited

U.S. PATENT DOCUMENTS 6,124,809 A 9/2000 Boudriau
6,159,059 A 12/2000 Bernier et al.
6,554,661 B1 * 4/2003 Bernier et al. ..... 440/40
6,589,085 B1 * 7/2003 Matsuda et al. ..... 440/1
6,722,302 B1 * 4/2004 Matsuda et al. ..... 114/144 R

FOREIGN PATENT DOCUMENTS

CA 2207938 7/1998

* cited by examiner

*Primary Examiner*—Ajay Vasudeva
(74) *Attorney, Agent, or Firm*—Alleman Hall McCoy Russell & Tuttle LLP

(57) ABSTRACT

A thrust control apparatus for a jet propulsion watercraft is provided. The thrust control apparatus includes a throttle sensor for detecting a fully-closed operation of a throttle of the engine, a steering sensor for detecting steering of a steering device more than a predetermined amount from a neutral position of the steering device and a direction of the steering; a control device configured to control the engine such that the water jet pump generates a different thrust for rightward and leftward steering, in accordance with the steering direction detected by the steering sensor, when the throttle sensor detects the fully-closed operation of the throttle and the steering sensor detects steering of more than the predetermined amount.

8 Claims, 10 Drawing Sheets

THRUST CONTROL DEVICE FOR JET PROPULSION WATERCRAFT

TECHNICAL FIELD

The present invention relates to a thrust control apparatus for a jet propulsion watercraft. More particularly, the present invention relates to a thrust control apparatus which controls a watercraft engine which drives a water jet pump, to have the water jet pump generate a thrust necessary for steering when a throttle is in a fully-closed state and a steering device is steered more than a predetermined amount.

BACKGROUND OF THE INVENTION

Among the variety of water-jet-pump-propulsion type small watercraft, personal watercraft (PWC) are the most popular. Personal watercraft generally have a water jet pump impeller that rotates counterclockwise when seen from a rear of the watercraft when the watercraft travels forward. During forward travel, the watercraft tends to bank to the right due to a reactive force of impeller rotation; thus, the watercraft tends to turn to the right.

The water jet pump is configured so that its thrust direction can be changed by horizontally swinging a steering nozzle arranged behind the impeller and, thus, the watercraft makes a turn. Because of this configuration, it is more difficult to steer the watercraft when a throttle is in a fully-closed state.

U.S. Pat. No. 6,159,059, Canada patent No. 2,207,938, and U.S. Pat. No. 6,124,809 disclose a steering assist technique addressing the above difficulties. The disclosed steering assist technique is to make steering easier by controlling thrust when a throttle is in a fully-closed state and the steering is not easy to operate. The thrust is controlled so as to be increased independently of throttle operation.

However, the above disclosed technique has a drawback in that steering to the right and steering to the left does not work the same even if the thrust is increased in the same manner for both cases, due to a reactive force of impeller rotation.

BRIEF SUMMARY OF THE INVENTION

The present invention addresses the above-mentioned conditions, and one aspect of the present invention is to provide an improved thrust control apparatus for a jet propulsion watercraft.

A thrust control apparatus is provided for a jet propulsion watercraft including a water jet pump driven by an engine, wherein the watercraft travels by a thrust generated by the water jet pump. The thrust control apparatus includes a throttle sensor for detecting a fully-closed operation of a throttle of the engine, a steering sensor for detecting steering of a steering device more than a predetermined amount from a neutral position of the steering device and a direction of the steering, a control device configured to control the engine such that the water jet pump generates a different thrust for rightward and leftward steering, in accordance with the steering direction detected by the steering sensor, when the throttle sensor detects the fully-closed operation of the throttle and the steering sensor detects steering of more than the predetermined amount.

The thrust control apparatus is configured to control the engine to generate the different thrust for the steering direction. Thus, with this steering assist technique, it is possible to steer to either direction with substantially the same effort by the operator.

In another aspect of the present invention, the control device may be configured to control the engine to generate a larger thrust for steering to the left than for steering to the right where the water jet pump rotates counterclockwise when seen from rear when the watercraft travels forward.

In still another aspect of the present invention, the control device may be configured to operate when the watercraft travels rearward.

In a further aspect of the present invention, the watercraft may include a steering column coupled with the water jet pump so as to change a direction of the thrust to steer the watercraft, the steering sensor may include a permanent magnet configured to rotate together with the steering column and a pair of proximity switches configured to detect an approach of the permanent magnet thereto, each of the proximity switches are provided at positions angularly spaced apart evenly in the rotational direction of the steering column with respect to the permanent magnet, so as to detect a rotation of the permanent magnet with the steering column, and the steering sensor is configured to detect the direction of steering by a detection made by one of the proximity switches on the respective side of the steering.

In still another aspect of the present invention, the control device may be configured to control the thrust by changing an engine speed of the engine.

In still another aspect of the present invention, the control device may be configured to increase the engine speed by changing at least one of an amount of fuel injection from an injector of a fuel supplying device with which the engine is equipped and an ignition timing of an ignition coil.

In still another aspect of the present invention, the control device may be configured to increase the engine speed by changing at least one of an amount of fuel injection from an injector of a fuel supplying device with which the engine is equipped, an amount of air in a bypass passage of a throttle body, and an ignition timing of an ignition coil.

In still another aspect of the present invention, the control device may be configured to increase the engine speed by changing at least one of an amount of valve opening of a carburetor and an ignition timing of an ignition coil.

The above and further objects and features of the invention will more fully be apparent from the following detailed description with accompanying drawings.

DETAILED DESCRIPTION OF THE INVENTION

The present invention will now be described in detail referring to the accompanying drawings illustrating the embodiments thereof.

Figure 1:
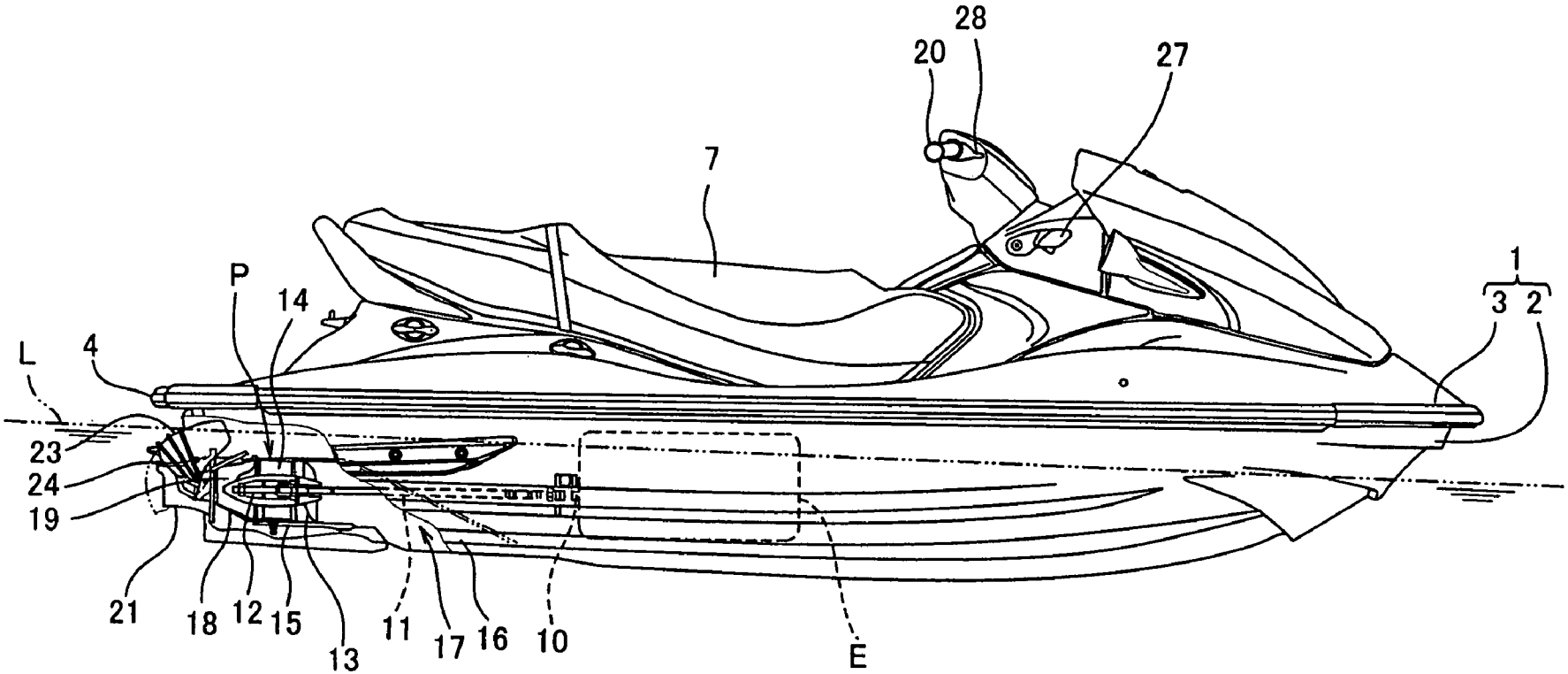
FIG. 1 is a right-side view showing an entire jet propulsion watercraft according to an embodiment of the present invention.
Figure 2:
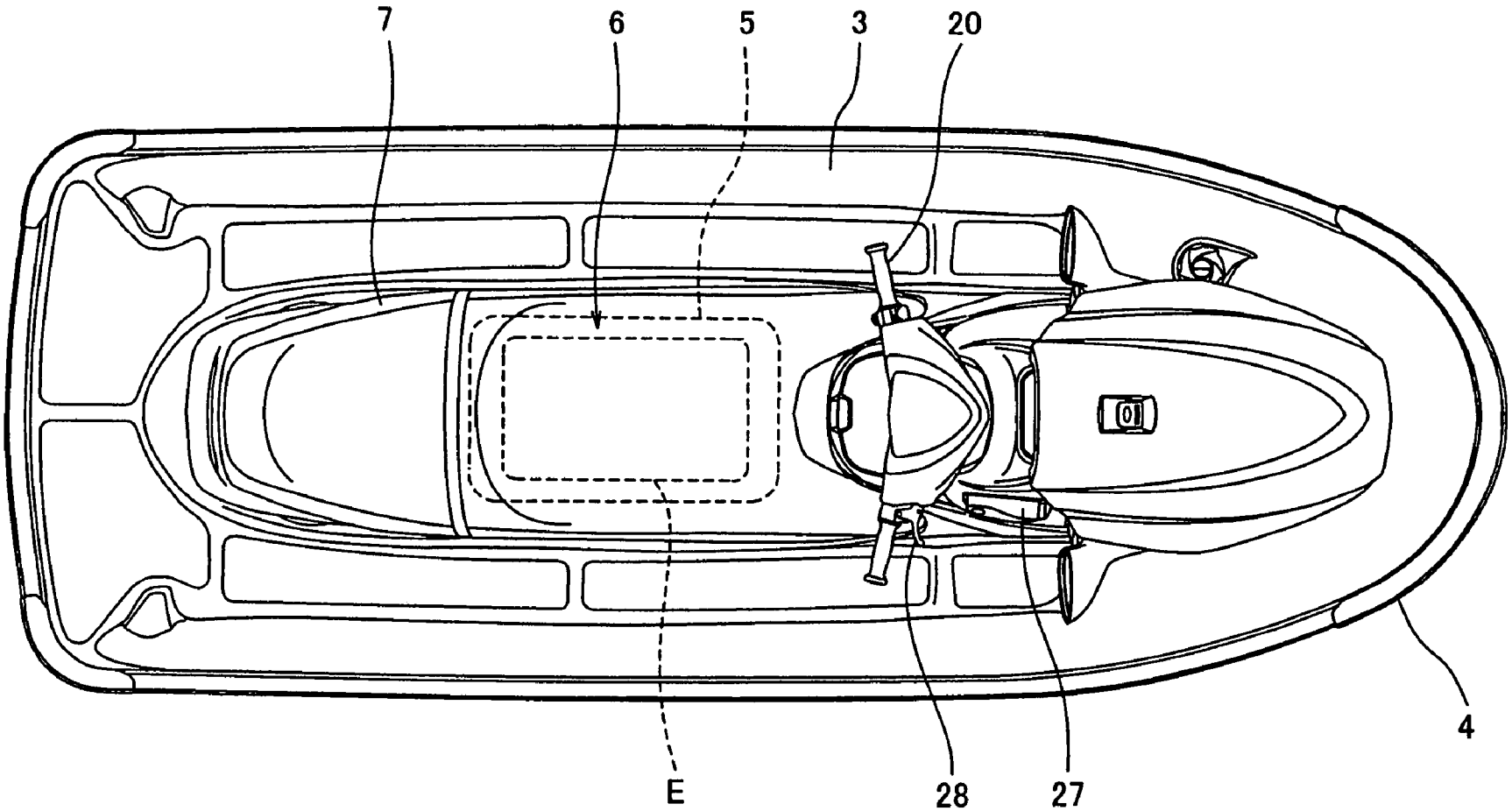
FIG. 2 is a plan view of the watercraft of FIG. 1.

FIG. 1 is a side view showing an entire jet propulsion watercraft according to an embodiment of the present invention, and FIG. 2 is a plan view of the jet propulsion watercraft shown in FIG. 1. In this embodiment, a personal watercraft (PWC) is illustrated as the jet propulsion watercraft. However, the jet propulsion watercraft of the present invention should not be understood as being limited to personal watercraft. Rather, the jet propulsion watercraft may be any suitable type of watercraft that travels by a thrust generated by a water jet pump.

In FIGS. 1 and 2, a body 1 of the jet propulsion watercraft includes a hull 2 and a deck 3 covering the hull 2 from above. The hull 2 and the deck 3 are connected to each other at a gunnel line 4 which extends over the entire perimeter of the hull 2 and the deck 3. In this embodiment, the gunnel line 4 is normally located above a waterline L (which is shown in a two-dot dashed line in FIG. 1) of the jet propulsion watercraft in a stationary condition.

As shown in FIG. 2, an opening 5 of substantially rectangular shape extending in the longitudinal direction of the watercraft is formed slightly rear of the middle section of the deck 3. The opening 5 is covered from above by a seat 7 which an operator straddles. An engine E is provided in a space (usually referred to as "an engine room") 6 surrounded by the hull 2 and the deck 3 below the seat 7.

As shown in FIG. 1, a crankshaft 10 of the engine E extends rearward, and a rear end portion of the crankshaft 10 is rotatably coupled integrally with a pump shaft 12 of a water jet pump P through a propeller shaft 11. An impeller 13 is attached on the pump shaft 12 of the water jet pump P. The impeller 13 is covered with a cylindrical pump casing 15 on the outer periphery thereof.

A water intake 16 is provided on the bottom of the hull 2. Water is sucked from the water intake 16 and fed to the water jet pump P through a water intake passage 17. The water jet pump P pressurizes and accelerates the water by rotation of the impeller 13. The pressurized and accelerated water is discharged through a pump nozzle 18 having a cross-sectional area of water flow gradually reduced rearward, and from an outlet port 19 provided on the rear end of the pump nozzle 18, thereby obtaining a thrust. In FIG. 1, a reference numeral 14 denotes fairing vanes for fairing water flow behind the impeller 13.

As shown in FIGS. 1 and 2, a reference numeral 20 denotes a bar-type steering handle. The steering handle 20 operates in association with a steering nozzle 21 swingable around a swing shaft (not shown) to the right or to the left behind the pump nozzle 18. When the operator rotates the steering handle 20 clockwise (to the right) or counterclockwise (to the left), the steering nozzle 21 is swung toward the opposite direction so that the watercraft can be correspondingly turned to a desired direction.

As shown in FIG. 1, a bowl-shaped reverse deflector 23 is provided above the rear section of the steering nozzle 21 such that it can swing downward around a horizontally mounted swinging shaft 24. Moreover, as shown in FIGS. 1 and 2, a reverse lever 27 for switching a traveling direction of the watercraft between forward and reverse is provided in proximity to the steering handle 20. In this embodiment, for example, it is provided in a front right portion of the hull 1.

Figure 3:
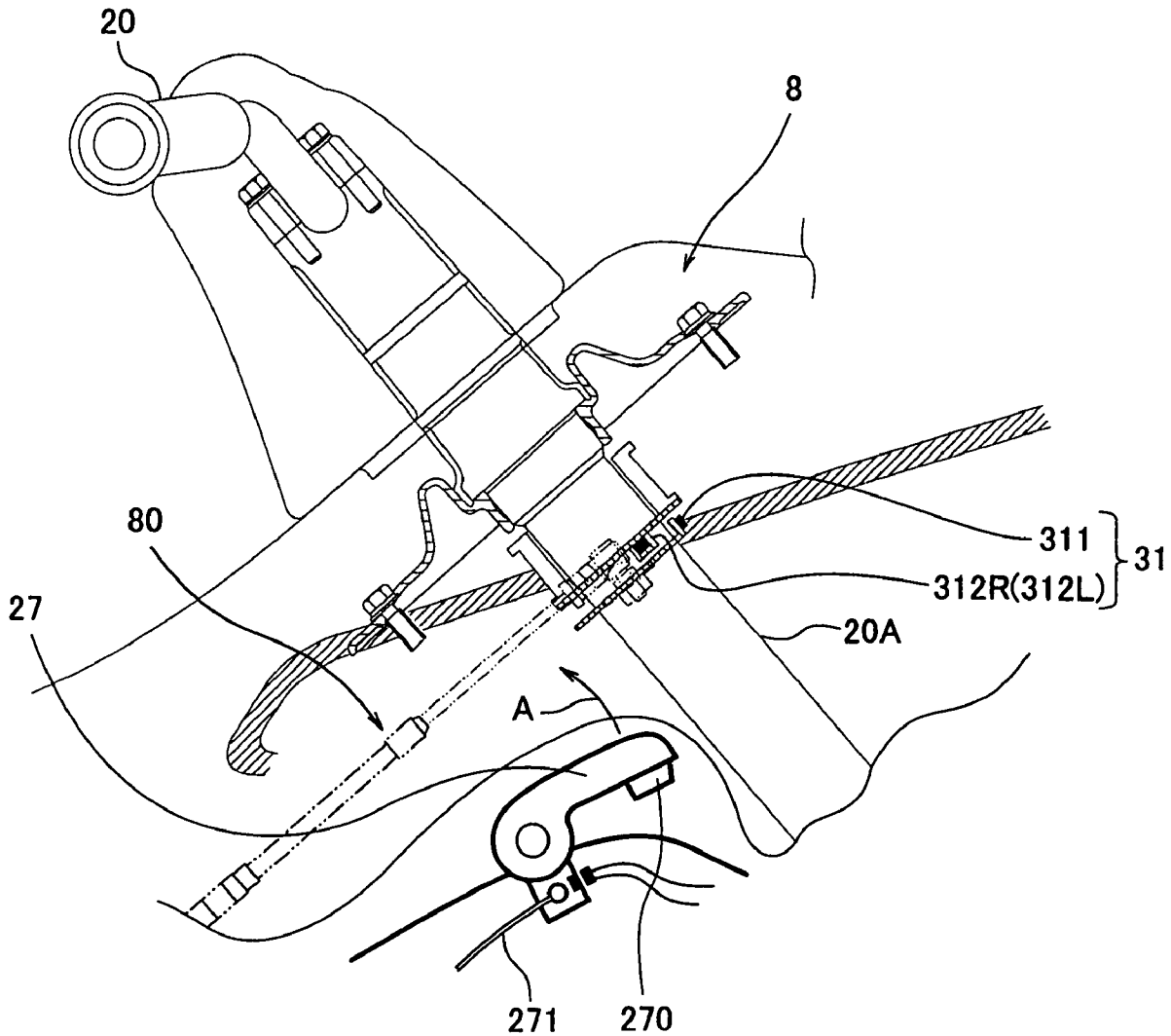
FIG. 3 is a partial enlarged sectional view of the watercraft of FIG. 1, showing a steering device and a reverse operating device.

FIG. 3 is a partial enlarged cross-sectional view of FIG. 1. The reverse lever 27 is pivotably coupled with the deck at the base end portion thereof and, includes a lock release button 270 at a tip end portion thereof for locking and releasing pivoting movement of the lever 27. Operator presses the lock release button 270 and pivotally raises the reverse lever 27 as indicated by an arrow "A", to pull a cable 271 which is connected at one end portion thereof to the base end portion of the reverse lever 27. As a result, the deflector 23 connected to the other end portion of the cable 271 is swung to the lower position behind the steering nozzle 18 and the water discharged rearward from the steering nozzle 18 is deflected forward. Thus, switching of watercraft travel direction from forward to rearward can be performed. In this state, upon the operator releasing the lock release button 270, the raised position of the reverse lever 27 is locked and the watercraft is maintained in a rearward traveling state. Then, further in this state, when the operator re-presses the lock release button 270 and pivotally lowers the reverse lever 27 toward the opposite direction, the watercraft can travel forward again.

Figure 4:
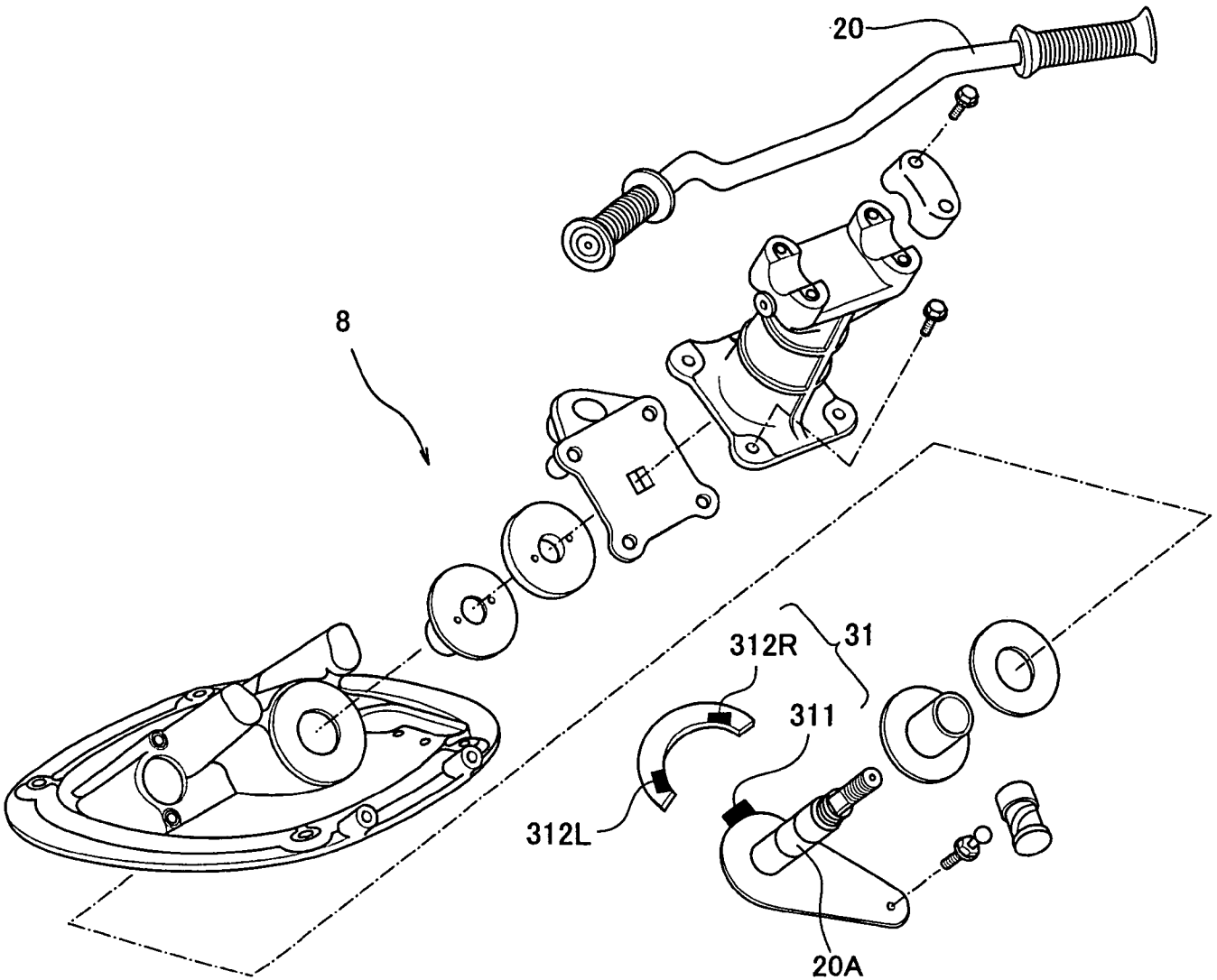
FIG. 4 is an exploded perspective view showing a steering sensor of the steering device of FIG. 3.

A steering device 8 of the jet propulsion watercraft according to this embodiment is shown in FIGS. 3 and 4. The steering device 8 includes the steering handle 20, a steering column 20A which holds the steering handle 20 at an upper end portion thereof and extends downwardly, and a link mechanism 80 which cooperatively couples the steering column 20A with the steering nozzle 21. The steering device 8 is provided with a steering sensor 31.

The steering sensor 31 may include any desirable switch or switches, such as one or more limit switches, or any desirable sensor or sensors which is/are capable of detecting angles such as one or more potentiometers. Alternatively, as shown in FIG. 4, the steering sensor 31 may include a permanent magnet 311 and a pair of steering sensor components 312R and 312L, each of which is constituted with a proximity switch in this embodiment. The permanent magnet 311 is typically attached to a portion of a circular-plate member fixed to a steering column 20A of the steering handle 20 so as to rotate together with the steering column 20A. The steering sensor components 312R and 312L are typically provided at positions angularly spaced apart evenly with respect to the permanent magnet 311. The angle between the permanent magnet 311 and each steering sensor component may be any predetermined angle, such as 20 degrees. When the steering handle 20 is steered by the predetermined angle to either right or left direction from a neutral position, the permanent magnet 311 approaches a corresponding steering sensor component. When the permanent magnet 311 comes close enough to the steering sensor component (i.e., comes within a detection threshold of the steering sensor component), the sensor component generates a detection signal, thereby detecting a predetermined steering operation. The neutral position typically is such a position of a central-angular position between the pair of steering sensor components when the steering handle is not intended to be steered and when the steering nozzle 21 directs water from the pump nozzle 18 straightly rearward.

Figure 5:
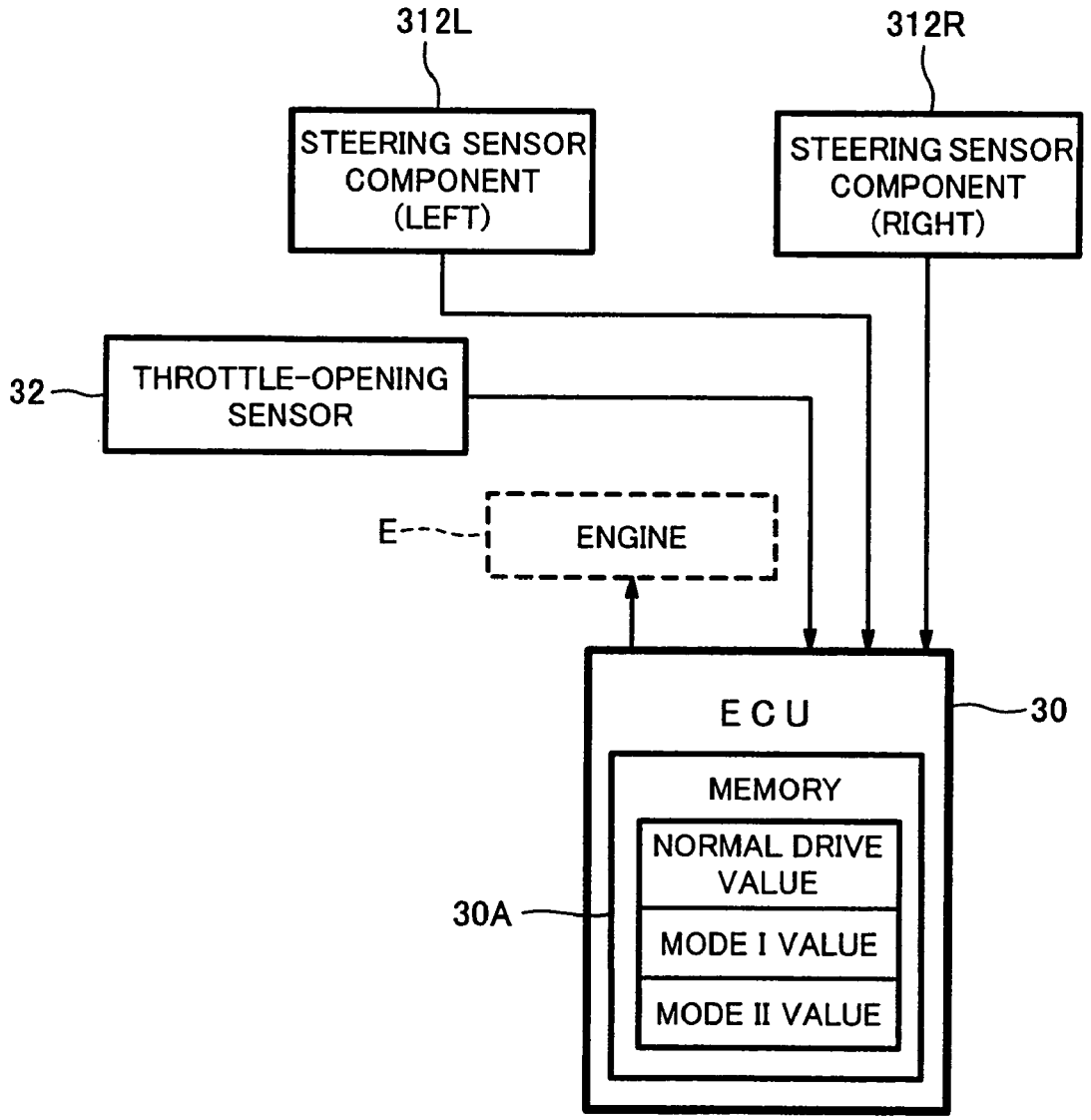
FIG. 5 is a block diagram showing a configuration of a thrust control apparatus with which the jet propulsion watercraft of FIG. 1 is equipped.

As shown in FIG. 5, an Electronic Control Unit (ECU) 30 provided in the jet propulsion watercraft is connected to each of the steering sensor components 312R and 312L. The detection signal generated and transmitted by each of the steering sensor components 312R and 312L is received by ECU 30. Typically, ECU 30 is also connected to a throttle-opening sensor 32 which detects an amount of throttle opening of the engine E, as a throttle sensor according to the present invention. In this embodiment, the throttle-opening sensor 32 is used to enable ECU 30 to detect "a fully-closed state of the throttle." Alternatively, for this purpose, other type of sensors, such as an engine speed sensor, a traveling speed sensor, and an acceleration sensor may be used as the throttle sensor. Use of these sensors as the throttle sensor is disclosed in (1) U.S. Pat. No. 6,551,152 filed on Jun. 8, 2001 and patented on Apr. 22, 2003, (2) U.S. Pat. No. 6,568,968 filed on Aug. 2, 2001 and patented on May 27, 2003, (3) U.S. Pat. No. 6,722,302 filed on Sep. 17, 2001 and patented on Apr. 20, 2004, and (4) U.S. Pat. No. 6,589,085 filed on Aug. 2, 2001 and patented on Jun. 8, 2003. The disclosure of these patents is hereby incorporated by reference.

As used herein, the term "throttle fully-closed state" includes a state where the throttle is completely closed and, further, a state where the throttle is nearly completely closed. The term also includes a state where the throttle is rapidly closed by a relatively large amount to any throttle position. These states and a description of the term "throttle fully-closed state" is disclosed in the above-mentioned patents (1) through (4), and are hereby incorporated by reference. In addition, as used herein, the term "a throttle fully-closed operation" includes an operation by the operator of the watercraft to place the throttle in "the throttle fully-closed state."

ECU 30 determines if the throttle is operated in "the throttle fully-closed state" based on a signal indicating the amount of throttle opening of the engine E given from the throttle-opening sensor 32, and ECU 30 also determines if the steering is steered more than a predetermined amount as well as a direction of the steering based on the detection signal given from either of the steering sensor components 312R and 312L. Next, ECU 30 controls the engine E to increase the thrust by a different amount depending on the steering direction when "the throttle fully-closed state" and "the steering more than the predetermined amount" are detected, as explained in more detail referring to a flowchart shown in FIGS. 6 and 7.

In order to generate the different amount of thrust for the steering direction, ECU 30 includes a memory 30A (in this embodiment, a type built in ECU 30), as shown in FIG. 5. The memory 30A typically stores a normal drive value used when ECU 30 executes a normal control of the engine E (herein called "normal drive"). The memory also stores a MODE I value and MODE II value corresponding to the amount of thrust to be generated for steering to the right and to the left, respectively.

Figure 6:
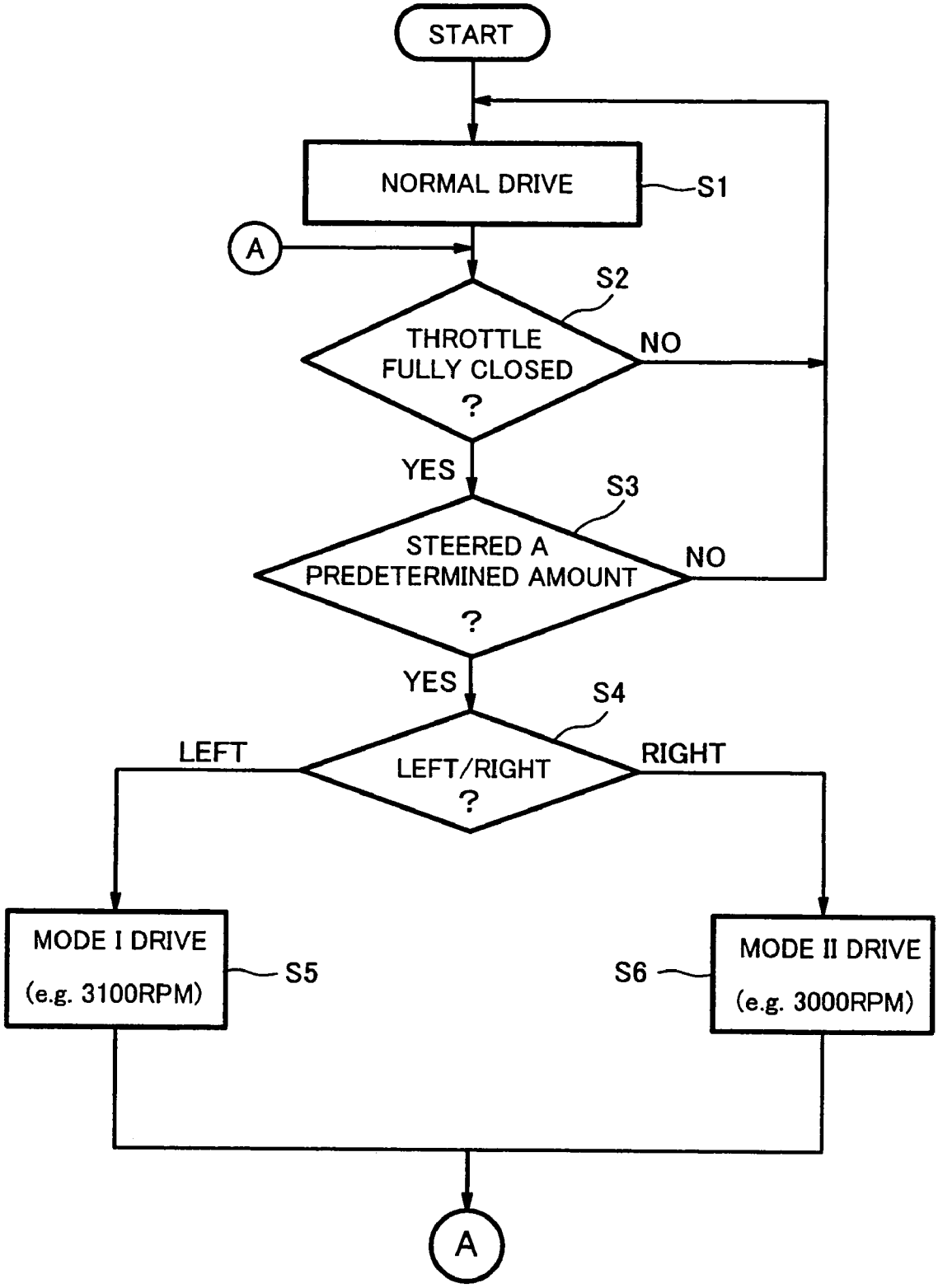
FIG. 6 is a flowchart showing a control sequence of an Electronic Control Unit (ECU) of the thrust control apparatus of FIG. 5 (when the watercraft is traveling forward)

Referring now to FIG. 6, first, a control of ECU 30 when the watercraft travels forward will be explained. ECU 30 is usually in the normal drive state where ECU 30 controls the engine E based on the normal drive value stored in the memory 30A (step S1). In this normal drive state, ECU 30 then determines whether or not the throttle is in "the throttle fully-closed state" based on the signal given from the throttle-opening sensor 32 (Step S2). If the throttle is in "the throttle fully-closed state" ("YES" at Step S2), ECU 30 then determines whether or not there is a detection signal indicating "the steering more than a predetermined amount" from the steering sensor component (Step S3).

If the throttle is not in "the throttle fully-closed state" ("NO" at Step S2), or if there is not a detection signal indicating "the steering more than a predetermined amount" ("NO" at Step S3), ECU 30 returns to Step S1 and continues "the normal drive." As used herein, the term "normal drive" includes a state of ECU 30 not using the control utilizing the steering assist technique (or simply the steering assist control) according to the present invention. The normal control in the normal drive typically includes a control of the engine E by ECU 30 based on the amount of throttle opening. These states and control during the states are also disclosed in the above-mentioned patents (1) through (4), and are hereby incorporated by reference.

On the other hand, if there is a detection signal indicating "steering more than a predetermined amount" ("YES" at Step S3), ECU 30 determines whether the detection signal is from the steering sensor component 312R or the steering sensor component 312L (Step S4). For example, if the detection signal is from the left-side steering sensor component 312L ("LEFT" at Step S4), ECU 30 controls the engine E based on the MODE I value (for example, 3100 rpm) stored in the memory 30A to increase the thrust (Step S5) and, then, returns to Step S2. Alternatively, for example, if the detection signal is from the right-side steering component 312R ("RIGHT" at Step S4), ECU 30 controls the engine E based on the MODE II value (for example, 3000 rpm) stored in the memory 30A to increase the thrust (Step S6) and, then, returns to Step S2.

Typically, the target value of the engine speed based on the MODE I value for the leftward steering is set as a larger value than the target value of the engine speed based on the MODE II value for the rightward steering, in order to cancel out the influence of reactive force mentioned above.

Figure 7:
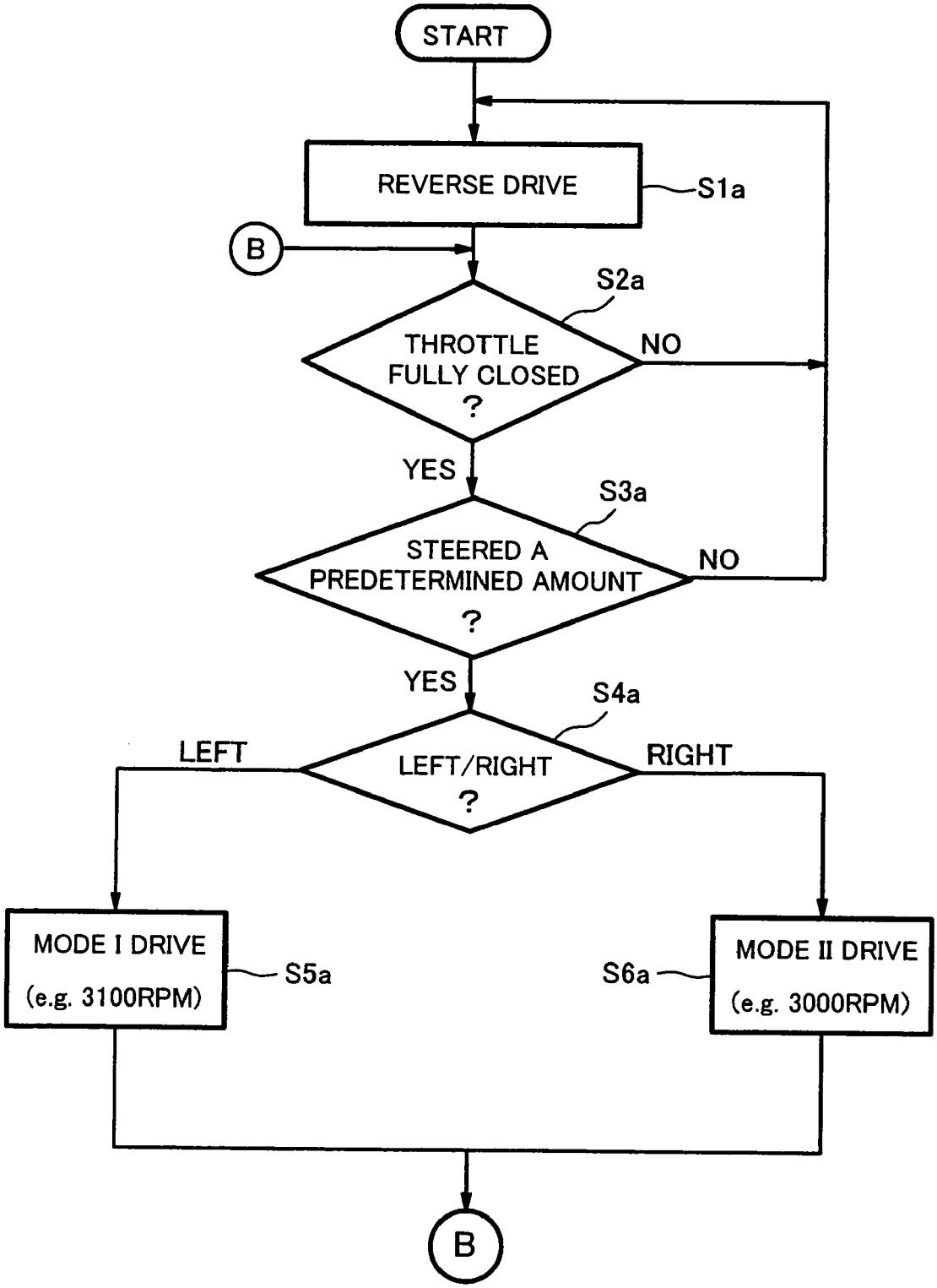
FIG. 7 is a flowchart showing a control sequence of the ECU of the thrust control apparatus of FIG. 5 (when the watercraft is traveling rearward)

Similarly, a control process of ECU 30 when the watercraft travels rearward may be as shown in FIG. 7 (steps S1*a* to S6*a*). However, target values of the engine speed for this case may be adjusted depending on reflective characteristics of water stream by the deflector 23.

Figure 8:
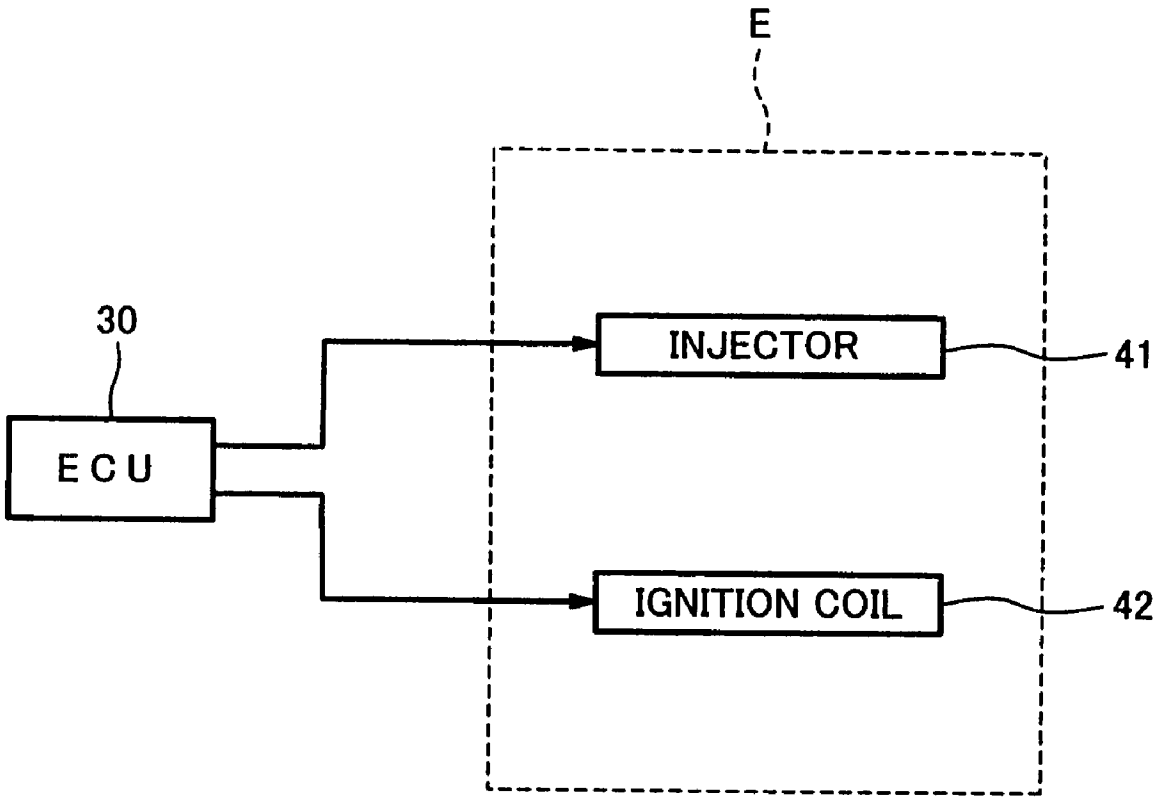
FIG. 8 is an exemplary configuration of a portion of the thrust control apparatus shown in FIG. 5, in which the ECU increases an engine speed.
Figure 9:
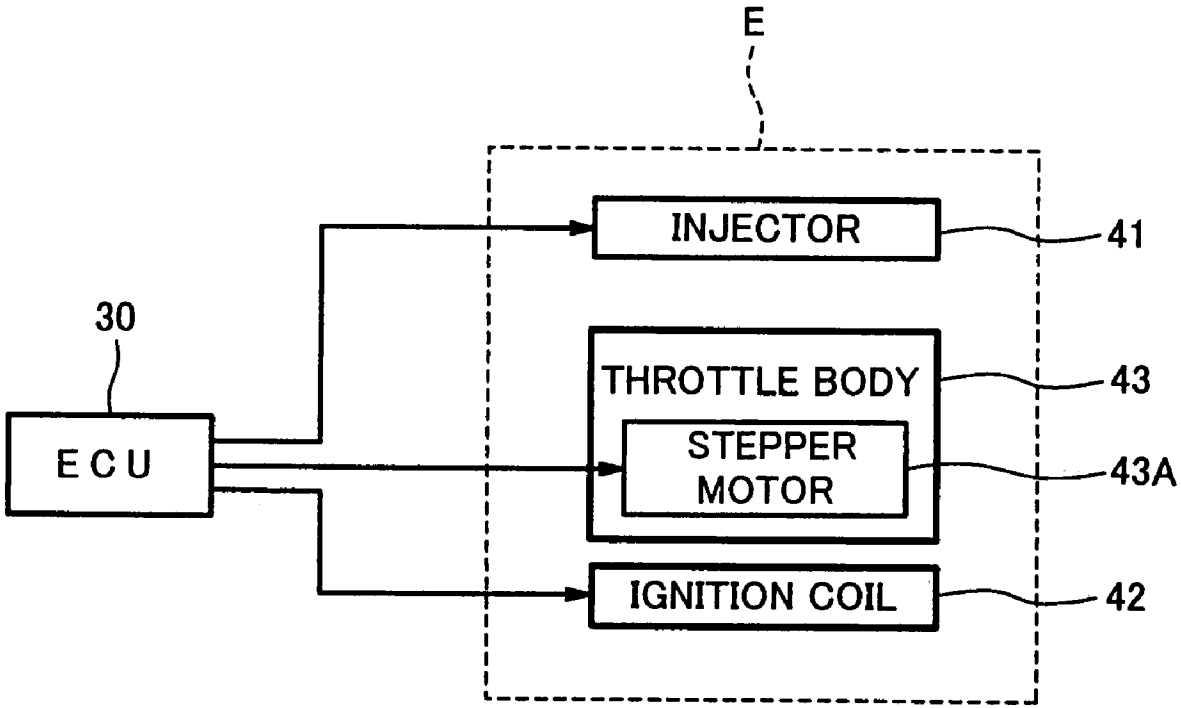
FIG. 9 is another exemplary configuration of a portion of the thrust control apparatus shown in FIG. 5, in which the ECU increases the engine speed.
Figure 10:
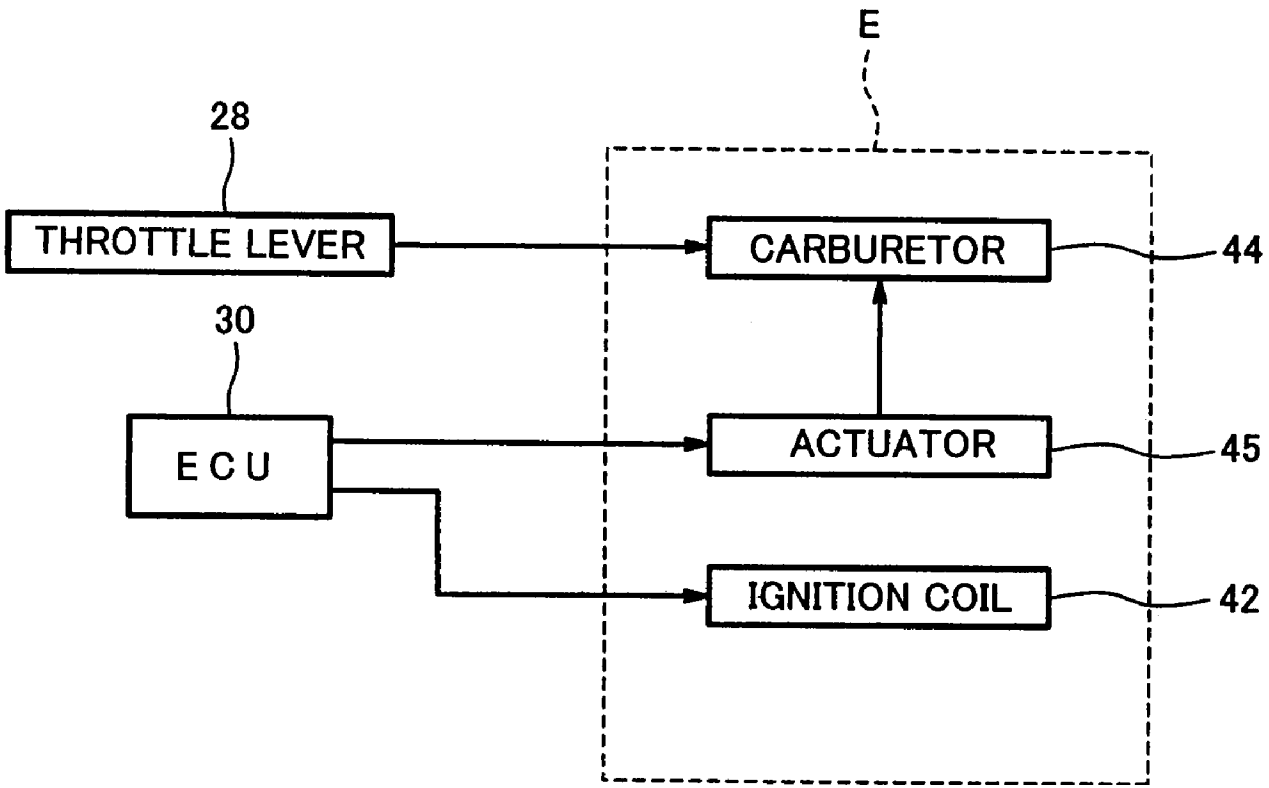
FIG. 10 is still another exemplary configuration of a portion of the thrust control apparatus shown in FIG. 5, in which the ECU increases the engine speed.

In order to control the engine E so as to increase the thrust, the engine E typically is controlled to increase the engine speed as mentioned above. The other method may be utilized as long as the thrust can be increased. Further, in order to increase the engine speed, a configuration of the thrust control apparatus as shown in FIGS. 8 to 10 may be used. In FIGS. 8 to 10, only a portion of the thrust control apparatus is shown.

For example, as shown in FIG. 8, if the engine E includes a fuel supplying device of a direct injection type, the increase of the engine speed may be made by changing an amount of fuel injection (e.g. by flow rate) from injector 41, and/or by changing an ignition timing of the ignition coil 42.

Alternatively, as shown in FIG. 9, if the engine E is a four-cycle engine, the increase of the engine speed may be made by changing an amount of fuel injection (e.g. by flow rate) from injector 41, and/or by changing an amount of valve opening by a stepper motor 43A which adjusts an amount of air (e.g. by flow rate) in a bypass passage of a throttle body 43, and/or by changing an ignition timing of the ignition coil 42.

Alternatively, as shown in FIG. 10, if the engine E includes a carburetor-type fuel supplying device, the increasing of the engine speed may be made by changing an amount of a throttle valve opening of a carburetor 44 by an actuator 45 which drives the throttle valve of the carburetor 44, and/or by changing an ignition timing of the ignition coil 42. The carburetor 44 is typically connected with a throttle lever 28 (also referred to FIGS. 1 and 2) which is operated to change the amount of the throttle valve opening of the carburetor 44. The actuator 45 can also change the amount of the throttle valve opening of the carburetor 44 independently from the throttle lever 28.

Here, similar examples of control processes in which an engine speed is increased are disclosed in the above-mentioned (1) through (4) patents, and are hereby incorporated by reference.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

The invention claimed is:

1. A thrust control apparatus for a jet propulsion watercraft including a water jet pump driven by an engine, wherein the watercraft travels by a thrust generated by the water jet pump, the thrust control apparatus comprising:

a throttle sensor for detecting a fully-closed operation of a throttle of the engine;

a steering sensor for detecting steering of a steering device more than a predetermined amount from a neutral position of the steering device, and a direction of the steering;

a control device configured to control the engine such that the water jet pump generates a different predetermined thrust for rightward steering than for leftward steering at a given traveling speed of the watercraft, in accordance with the steering direction detected by the steering sensor, when the throttle sensor detects the fully-closed operation of the throttle and the steering sensor detects steering of more than the predetermined amount.

2. The thrust control apparatus of claim 1, wherein the water jet pump rotates counterclockwise when seen from rear when the watercraft travels forward; and wherein the control device is configured to control the engine to generate a larger thrust for leftward steering than that for rightward steering.

3. The thrust control apparatus of claim 1, wherein the control device is configured to operate when the watercraft travels rearward.

4. The thrust control apparatus of claim 1, wherein the watercraft includes a steering column coupled with the water jet pump so as to change a direction of the thrust to steer the watercraft;

wherein the steering sensor includes a permanent magnet configured to rotate together with the steering column and a pair of proximity switches configured to detect an approach of the permanent magnet thereto;

wherein each of the proximity switches are provided at positions angularly spaced apart evenly in the rotational direction of the steering column with respect to the permanent magnet, so as to detect a rotation of the permanent magnet with the steering column; and wherein the steering sensor detects the direction of the steering by a detection made by one of the proximity switches on the respective side of the steering.

5. The thrust control apparatus of claim 1, wherein the control device is configured to control the thrust by changing an engine speed of the engine.

6. The thrust control apparatus of claim 5, wherein the control device is configured to increase the engine speed by changing at least one of an amount of fuel injection from an injector of a fuel supplying device with which the engine is equipped and an ignition timing of an ignition coil.

7. The thrust control apparatus of claim 5, wherein the control device is configured to increase the engine speed by changing at least one of an amount of fuel injection from an injector of a fuel supplying device with which the engine is equipped, an amount of air in a bypass passage of a throttle body, and an ignition timing of an ignition coil.

8. The thrust control apparatus of claim 5, wherein the control device is configured to increase the engine speed by changing at least one of an amount of valve opening of a carburetor and an ignition timing of an ignition coil.

* * * * *